US009076421B1

(12) United States Patent
Munoz

(10) Patent No.: US 9,076,421 B1
(45) Date of Patent: Jul. 7, 2015

(54) WIRELESS HEADSET FOR KARAOKE INSIDE A VEHICLE

(71) Applicant: Dennis G. Munoz, Chino Hills, CA (US)

(72) Inventor: Dennis G. Munoz, Chino Hills, CA (US)

( * ) Notice: Subject to any disclaimer, the term of this patent is extended or adjusted under 35 U.S.C. 154(b) by 314 days.

(21) Appl. No.: 13/851,710

(22) Filed: Mar. 27, 2013

(51) Int. Cl.
*G10H 1/36* (2006.01)

(52) U.S. Cl.
CPC ..... *G10H 1/361* (2013.01)

(58) Field of Classification Search
CPC ..... G10H 1/361; G10H 1/363; G10H 1/365; G10H 1/366; G10H 1/368
See application file for complete search history.

(56) References Cited

U.S. PATENT DOCUMENTS

| | | | | |
|---|---|---|---|---|
| D364,617 | S | 11/1995 | Fitzgerald | |
| 5,885,085 | A | 3/1999 | Fujita | |
| 7,899,398 | B2 | 3/2011 | Lee | |
| 2004/0116069 | A1 | 6/2004 | Fadavi-Ardekani et al. | |
| 2005/0092162 | A1 * | 5/2005 | Whitener et al. | 84/625 |
| 2005/0106546 | A1 | 5/2005 | Strom | |
| 2006/0050894 | A1 | 3/2006 | Boddicker et al. | |
| 2007/0234888 | A1 | 10/2007 | Rotolo de Moraes | |
| 2009/0022330 | A1 | 1/2009 | Haulick et al. | |

* cited by examiner

*Primary Examiner* — Ping Lee

(57) ABSTRACT

The present invention features a wireless headset system for karaoke inside a vehicle. A driver or passenger wears the headset and sings with a music being played by a vehicle music player. The headset has a microphone to pick up the singing voice and send the voice to a vehicle sound system via Bluetooth connection. The vehicle sound system plays the voice via the vehicle speakers together with the music files being played.

7 Claims, 3 Drawing Sheets

(Block Diagram)

(Side View)

(Bottom View)

(ISO View)

(In-use View)

(Block Diagram)

WIRELESS HEADSET FOR KARAOKE INSIDE A VEHICLE

FIELD OF THE INVENTION

The present invention relates to a wireless headset, and more particularly to a wireless headset for karaoke inside a vehicle.

BACKGROUND OF THE INVENTION

Many people enjoy singing within a vehicle when they hear a favorite song. However, most vehicle sound system can play music from single source, either from radio, disk files, or external resources via aux input or Bluetooth connection. Therefore, there is a need for a music system inside a vehicle that allows a driver to sing, wherein such a system can receive send the driver/passenger's voice and play the voice via the vehicle speakers together with the music files being played.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a wireless headset system for karaoke inside a vehicle. A driver or passenger wears the headset and sings with a music being played by a vehicle music player. The headset has a microphone to pick up the singing voice and send the voice to a vehicle sound system via Bluetooth connection. The vehicle sound system plays the voice via the vehicle speakers together with the music files being played.

DESCRIPTION OF PREFERRED EMBODIMENTS

Figure 1:
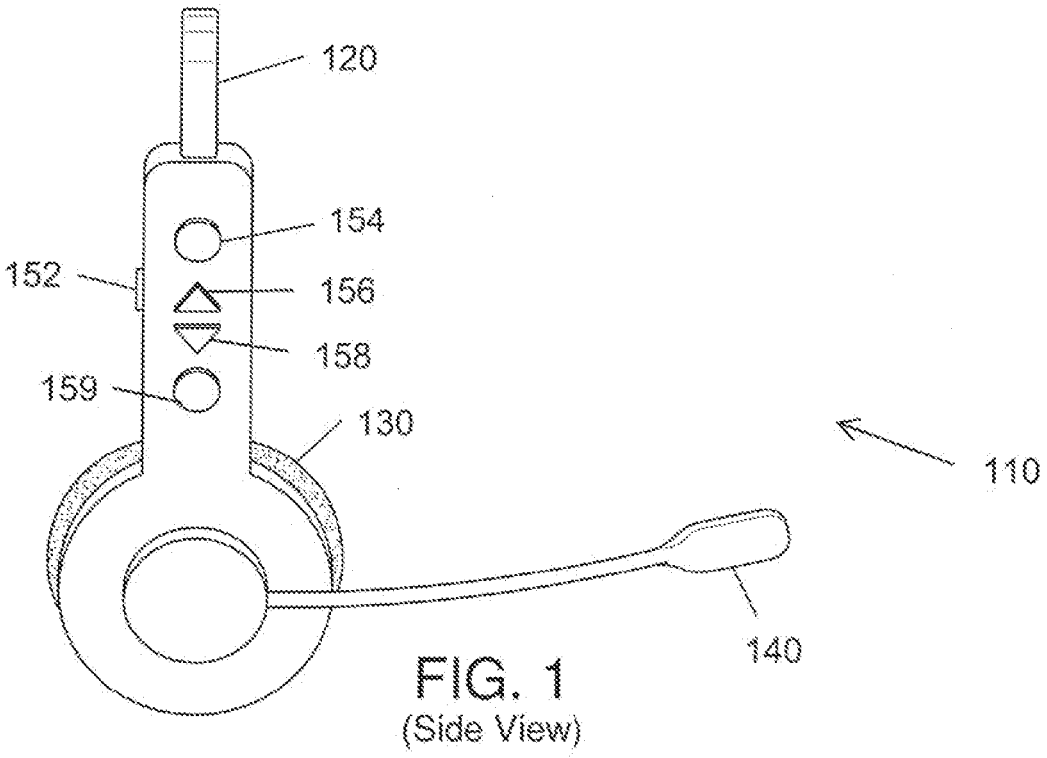
FIG. 1 shows a side view of a hands-free headset.

Following is a list of elements corresponding to a particular element referred to herein:

100 hands-free headset system
105 user
110 headset
120 headband
121 first end of the headband
122 second end of the headband
125 outside surface of the headset
126 inside surface of the headset
124 pad
130 headphone
140 microphone
142 microphone connection conduit
152 power ON/OFF switch

Figure 2:
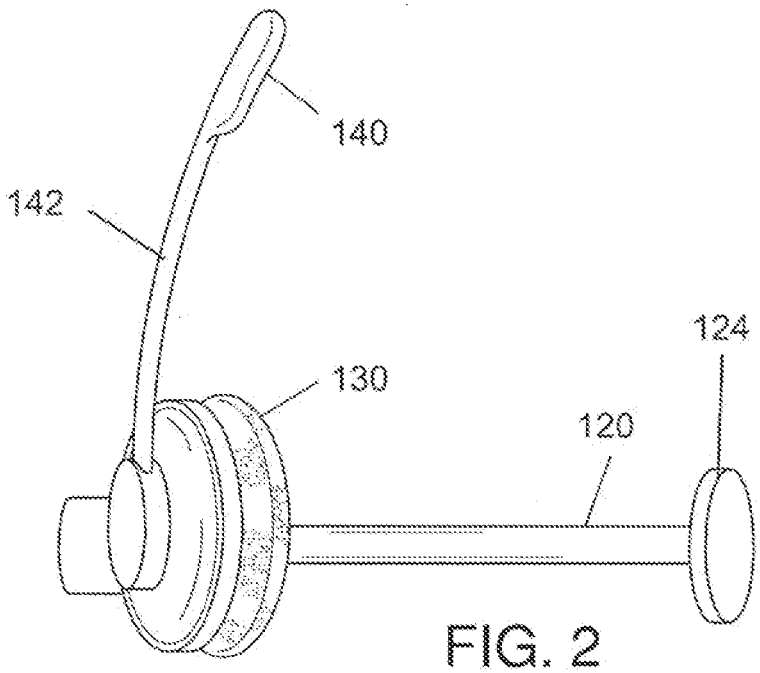
FIG. 2 shows a bottom view of the hands-free headset.
Figure 3:
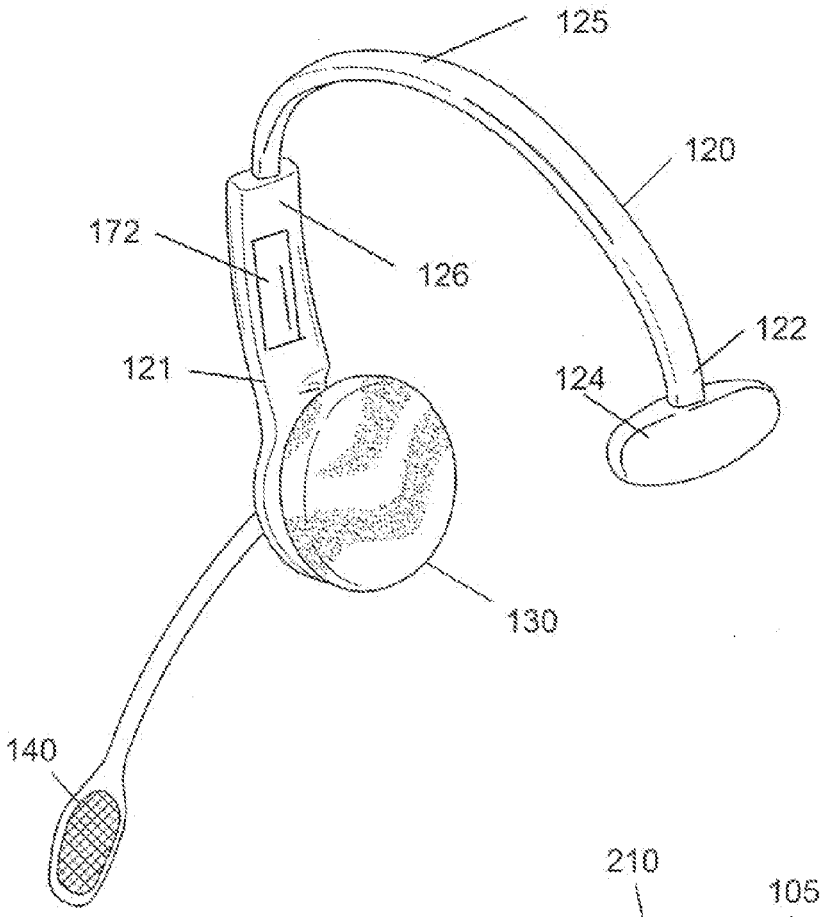
FIG. 3 shows an isometric view of the hands-free headset.
Figure 4:
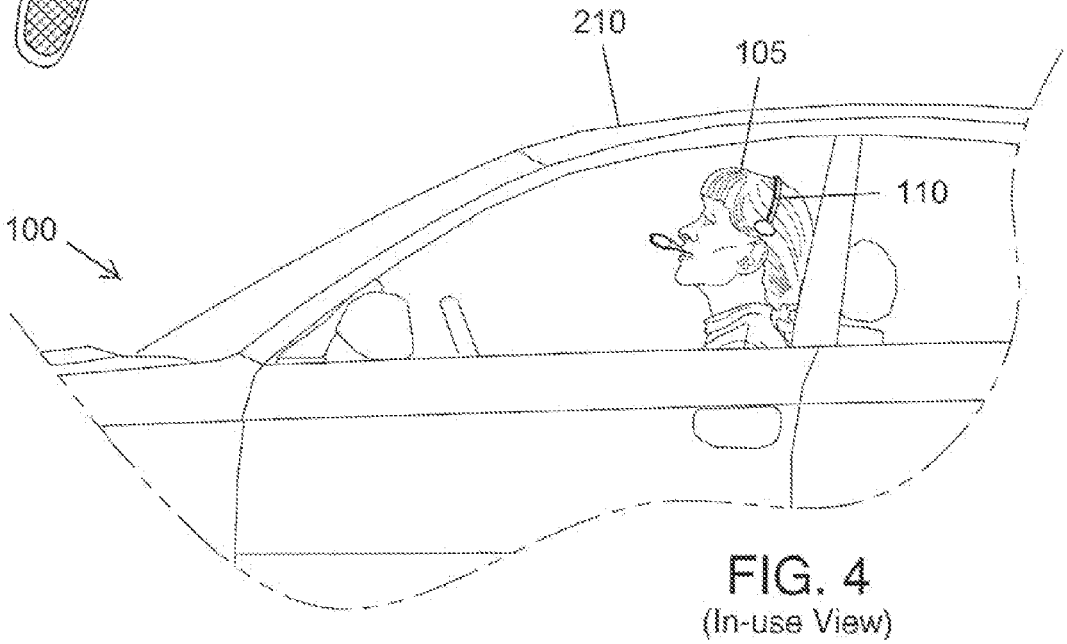
FIG. 4 shows an in-use view of the hands-free headset inside a vehicle.
Figure 5:
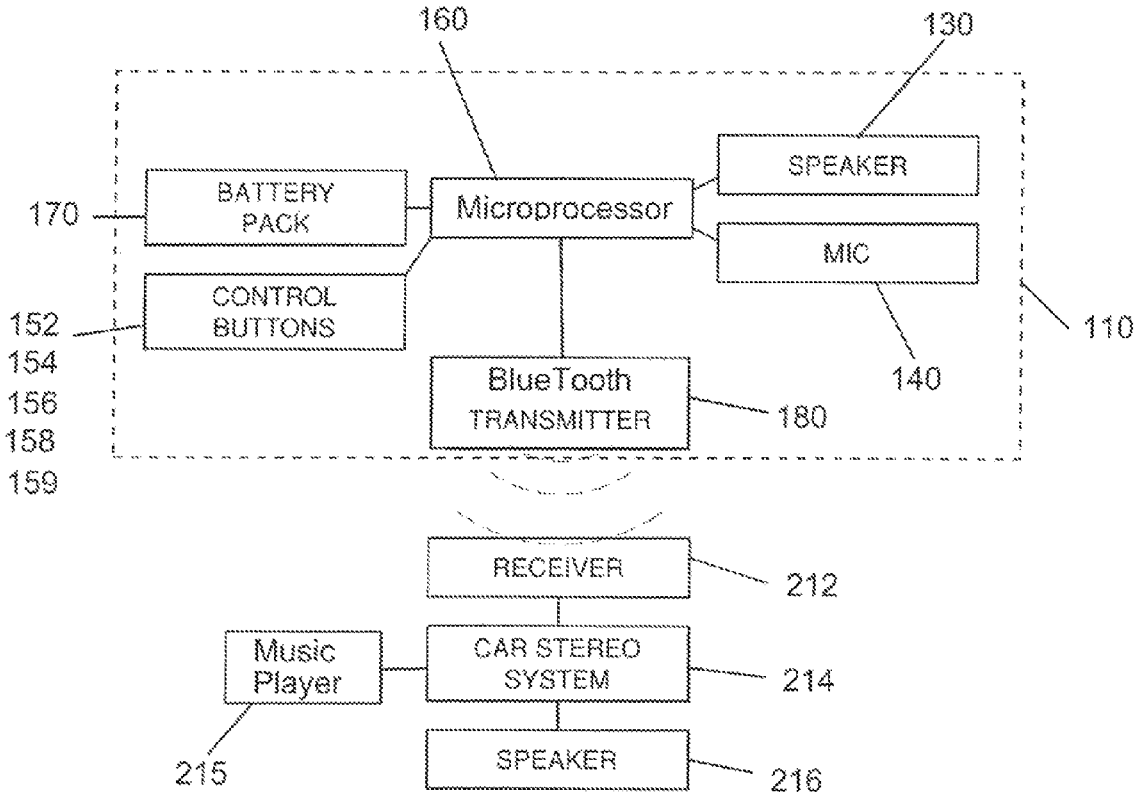
FIG. 5 shows a block diagram of the hands-free headset system.

154 function switch
156 volume up button
158 volume down button
159 reverb switch
160 microprocessor
170 battery pack
172 battery compartment
180 Bluetooth transmitter
210 vehicle
212 Bluetooth receiver
214 car stereo system
215 music player
216 speaker Referring now to FIGS. 1-5, the present invention features a wireless headset system (100) for karaoke inside a vehicle (210) with a wireless headset (110). The vehicle (210) comprises a car stereo system (214), at least one speaker (216), a music player (215) and a Bluetooth receiver (212); where the music player (215) is configured to play a music file with a music signal being sent to the speaker (216) via the car stereo system (214). The music file is a compact disk (CD) track, an mp3 file, a wma file or an audio track of a video file.

The headset is a wireless single-earpiece headset (110) comprising an over-the-head headband (120) with a first end (121) and a second end (122), wherein a pad (124) is attached to the second end (122); a headphone (130) attached to the first end (122) of the headband (120); a microphone (140) attached to the first end (122) of the headband (120) via a microphone connection conduit (142); a power ON/OFF switch (152), a function switch (154), a volume up button (156) and volume down button (158) disposed on the headband (120) adjacent to the first end (121); a microprocessor (160), a battery (170) and a Bluetooth transmitter (180) disposed within the headset (110).

The microphone is configured to pick up a voice signal when the user sings. The microprocessor (160) is operatively connected to the microphone (140), the headphone (130), the battery (170), the Bluetooth transmitter (180), the power ON/OFF button (152), the function switch (154), the volume up button (156) and the volume down button (158).

The microprocessor is configured to turn off the microphone (140) when the power ON/OFF switch is turned off, wherein the microprocessor is configured and turn on the microphone (140) when the power ON/OFF switch is turned on.

The microprocessor is configured to receive the voice signal from the microphone (140), wherein when the function button is tuned ON, the microprocessor is configured to send the voice signal to the headphone (130).

When the function switch is tuned OFF, the microprocessor is configured to send the voice signal to the Bluetooth transmitter (180), wherein the Bluetooth transmitter (180) is configured to send the voice signal to the Bluetooth receiver (212); wherein the Bluetooth receiver (212) sends the voice signal to the car stereo system (214); wherein the car stereo system (214) mixes the voice signal and the music signal into a mixed signal, wherein the mixed signal is sent to the speaker (216).

In some embodiments, the headband (120) is length adjustable. In some embodiments, the microphone connection conduit (142) is length adjustable.

In some embodiments, the battery (170) resides within a battery compartment (172) disposed on the inside surface (126) of the headband adjacent to the first end (121).

In some embodiments, the headset (110) further comprises a reverb switch (159), wherein the reverb switch (159) is operatively connected to the microprocessor (160), wherein the power ON/OFF switch, function switch and the reverb switch (159) are tuned on, the microprocessor (160) is configured to receive the voice signal from the microphone (140) and add a pre-determined numbers of echoes of the voice signal, wherein the microprocessor is configured to send the voice signal and the added echoes together to the Bluetooth transmitter.

In some embodiments, the power ON/OFF switch (152), the function switch (154) and the reverb button (159) are push-button switches or micro switches. Push-button switches or micro switches are well known to one of ordinary skill in the art.

The disclosures of the following U.S. Patents are incorporated in their entirety by reference herein: (1) U.S. Pat. No. 5,850,585, (2) U.S. Pat. No. 7,899,398, (3) US 2005/0106546A1, (4) US 2006/0050894A1, (5) US2007/0234888A1, (6) US 2009/0022330A1 and (7) USD 364617.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A wireless headset system (100) for karaoke inside a vehicle, the system comprises:

(i) a wireless single-earpiece headset (110), wherein the headset comprising:

(a) an over-the-head headband (120) with a first end (121) and a second end (122), wherein a pad (124) is attached to the second end (122), wherein the headband is wearable on a user's (105) head;

(b) a headphone (130) attached to the first end (122) of the headband (120);

(c) a microphone (140) attached to the first end (122) of the headband (120) via a microphone connection conduit (142); wherein the microphone is configured to pick up a voice signal when the user sings;

(d) a power ON/OFF switch (152), a function switch (154), a volume up button (156) and volume down button (158) disposed on the headband (120) adjacent to the first end (121);

(e) a microprocessor (160), a battery (170) and a Bluetooth transmitter (180) disposed within the headset (110), wherein the microprocessor (160) is operatively connected to the microphone (140), the headphone (130), the battery (170), the Bluetooth transmitter (180), the power ON/OFF button (152), the function switch (154), the volume up button (156) and the volume down button (158);

(ii) a vehicle (210) comprising a car stereo system (214), at least one speaker (216), a music player (215) and a Bluetooth receiver (212); where the music player (215) is configured to play a music file with a music signal being sent to the speaker (216) via the car stereo system (214);

wherein the microprocessor is configured to turn off the microphone (140) when the power ON/OFF switch is turned off, wherein the microprocessor is configured and turn on the microphone (140) when the power ON/OFF switch is turned on;

wherein the microprocessor is configured to receive the voice signal from the microphone (140), wherein when the function button is tuned ON, the microprocessor is configured to send the voice signal to the headphone (130); and wherein when the function switch is tuned OFF, the microprocessor is configured to send the voice signal to the Bluetooth transmitter (180), wherein the Bluetooth transmitter (180) is configured to send the voice signal to the Bluetooth receiver (212); wherein the Bluetooth receiver (212) sends the voice signal to the car stereo system (214); wherein the car stereo system (214) mixes the voice signal and the music signal into a mixed signal, wherein the mixed signal is sent to the speaker (216).

2. The wireless headset system (100) of claim 1, wherein the headband (120) is length adjustable.

3. The wireless headset system (100) of claim 1, wherein the microphone connection conduit (142) is length adjustable.

4. The wireless headset system (100) of claim 1, wherein the battery (170) resides within a battery compartment (172) disposed on the inside surface (126) of the headband adjacent to the first end (121).

5. The wireless headset system (100) of claim 1, wherein the headset (110) further comprises a reverb switch (159), wherein the reverb switch (159) is operatively connected to the microprocessor (160), wherein the power ON/OFF switch, function switch and the reverb switch (159) are tuned on, the microprocessor (160) is configured to receive the voice signal from the microphone (140) and add a pre-determined numbers of echoes of the voice signal, wherein the microprocessor is configured to send the voice signal and the added echoes together to the Bluetooth transmitter.

6. The wireless headset system (100) of claim 1 or 5, wherein the power ON/OFF switch (152), the function switch (154) and the reverb button (159) are push-button switches or micro switches.

7. The wireless headset system (100) of claim 1, wherein the music file is a compact disk (CD) track, an mp3 file, a wma file, an audio track of a video file.

* * * * *